US007370767B2

(12) United States Patent
Roodenburg et al.

(10) Patent No.: US 7,370,767 B2
(45) Date of Patent: May 13, 2008

(54) MOBILE CRANE

(75) Inventors: Joop Roodenburg, Delfi (NL); Diederick Bernardus Wijning, Schiedam (NL); Arie de Zwari, Reeuwijk (NL)

(73) Assignee: Itrec B.V., Schiedam (NL)

( * ) Notice: Subject to any disclaimer, the term of this patent is extended or adjusted under 35 U.S.C. 154(b) by 9 days.

(21) Appl. No.: 11/396,476

(22) Filed: Apr. 3, 2006

(65) Prior Publication Data

US 2006/0226105 A1 Oct. 12, 2006

(30) Foreign Application Priority Data

Jul. 2, 2003 (NL) ..... 1023814

(51) Int. Cl.
*B66C 23/76* (2006.01)

(52) U.S. Cl. ..... 212/178; 212/196

(58) Field of Classification Search ..... 212/178, 212/195–198

See application file for complete search history.

(56) References Cited

U.S. PATENT DOCUMENTS 3,734,302 A * 5/1973 Durand ..... 212/271
3,842,984 A * 10/1974 Brown et al. ..... 212/195
3,930,583 A * 1/1976 Jouffray ..... 212/195
4,258,852 A * 3/1981 Juergens ..... 212/178
4,266,679 A * 5/1981 Juergens ..... 212/181
4,614,275 A 9/1986 Zenno
6,283,315 B1 9/2001 Willim et al.
6,568,547 B1 5/2003 Kretschemer et al.
2002/0070186 A1 6/2002 Frommelt et al.

FOREIGN PATENT DOCUMENTS

DE 29724688 2/2003

* cited by examiner

*Primary Examiner*—Thomas J. Brahan
(74) *Attorney, Agent, or Firm*—Buskop Law Group, PC; Wendy Buskop

(57) ABSTRACT

The embodied mobile cranes have a travelling base structure that allows for travel of the crane over a surface. The cranes have a revolving superstructure mounted on the base structure and a boom and a backmast. The boom and backmast are each hinged about an associated pivot axis to horizontal the superstructure. The crane has a main load hoisting manner associated with the boom for hoisting a load. A superstructure ballast is supported on the superstructure. The cranes have a superlift ballast and associated connection manners to connect the superlift ballast to the backmast while the superlift ballast is resting on the surface and/or suspended from the backmast above the surface. The travelling base structure is provided with superlift ballast support to support the superlift ballast on the base structure so that the superlift ballast is movable along with the mobile crane while being supported by the base structure.

10 Claims, 6 Drawing Sheets

20a
20b
5
42
50
40
55
2

MOBILE CRANE

CROSS REFERENCE TO RELATED APPLICATIONS

The present application claims priority to co-pending International Application Number PCT/NL2003/000674 filed on Oct. 2, 2003, which claims priority to Netherlands Patent Application Number NL1023814 filed on Jul. 2, 2003.

FIELD

The embodiments relate to mobile cranes (for example, self-propelled mobile cranes) of the type having a travelling base structure which allows for travel of the crane over a surface and furthermore having a revolving superstructure mounted on the base structure and rotatable about a vertical revolving axis with respect to the base structure.

The embodiments further relate to methods for operating such a mobile crane.

The embodied cranes have a boom and a backmast. The boom and backmast are hinged about an associated horizontal pivot axis to the superstructure. For lifting a load, a main load hoisting means is associated with the boom for hoisting the load.

The embodied cranes have a superstructure ballast and the superstructure is adapted for supporting the superstructure ballast thereon. For performing so-called "superlifts", the embodied cranes have a superlift ballast. Associated connection means (for example, a multiple fall cable) serve to connect the superlift ballast to the backmast while the superlift ballast is resting on the surface and/or suspended from the backmast above the surface at a large distance from the base structure. The embodied cranes can resist very large overturning moments created by the load. In practice, the superlift ballast can weigh hundred or even several hundred metric tons. The ballast can be composed of a stack of heavy steel plates.

BACKGROUND

Mobile cranes are often employed for several lift jobs at a single construction site (for example, a chemical plant). For each job, the crane has to be moved to a new location and prepared for the new job. Typically, the crane has to be moved several tens or hundreds of meters.

A disadvantage of prior art mobile cranes relates to the practice described above, wherein the crane is moved from one location to the next. With most prior art cranes, additional cranes and transport vehicles are needed in order to move the superlift ballast to the new location. The use of additional cranes and transport vehicles is time consuming and poses additional safety hazards to personnel.

In some examples of the prior art, the superlift ballast is mounted on a separate wheeled ballast car attached to the superstructure, having steerable wheels driven by associated drive means. The problem is that this construction requires an extraordinary robust and expensive ballast car, which undesirably increases the costs of the crane. In another example, a mobile crane has a ballast car attached to the superstructure by a telescopic beam. Like the first example, this construction also has steerable wheels, resulting in an undesirable complex and costly ballast arrangement.

As another example, the Demag CC 8800 crane has a superlift ballast car (max 600 ton) attached to the base structure via a telescopic beam. This crane further has a superstructure ballast mounted on the rear end of the superstructure. For further stabilizing, the Demag CC 8800 crane uses a "central ballast" (max 100 ton) on the chassis of the base structure. This "central ballast" construction is done by providing the front and rear beam of the base structure with a centrally arranged support platform on which metal ballast plates can be stacked.

As another example of prior art, a crane is not provided with a superstructure ballast. Rather, the crane has a horizontal beam attached to the superstructure, wherein the horizontal beam carries the superlift ballast.

A need exists to provide an improved mobile crane, having provisions for handling the superlift ballast, which allows for a more efficient use of the crane at affordable costs.

The embodiments meet these needs.

BRIEF DESCRIPTION OF THE DRAWINGS

The detailed description will be better understood in conjunction with the accompanying drawings as follows.

The embodiments are detailed below with reference to the listed Figures.

DETAILED DESCRIPTION OF THE EMBODIMENTS

Before explaining the embodiments in detail, it is to be understood that the embodiments are not limited to the particular embodiments and that the embodiments can be practiced or carried out in various ways.

The embodiments provide for mobile cranes that can be characterized in that the travelling base structure is provided with superlift ballast support means that allow for supporting the superlift ballast on the base structure so that the superlift ballast is movable along with the mobile crane while being supported by the base structure.

The embodiments use the travelling base of the crane itself, which can be self-propelled, as means to support and transport the superlift ballast when moving the crane from one job site to the next. The construction can result in a crane of lower costs than the complex prior art designs and/or a crane which can be operated far more efficiently.

The embodiments also relate to methods for operating such a mobile crane.

Figure 1:
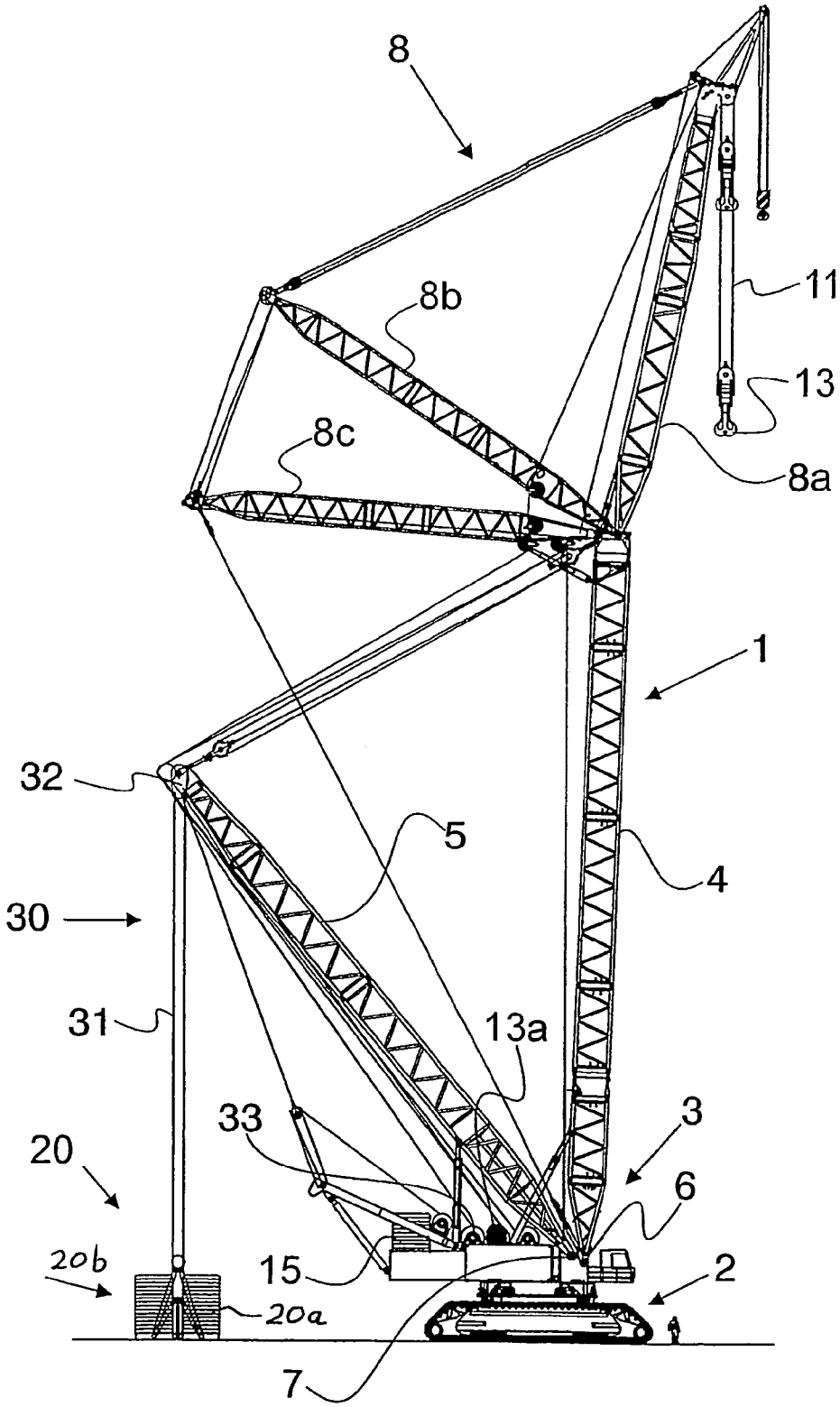
FIG. 1 depicts a side view of an embodiment of a crawler crane.
Figure 2:
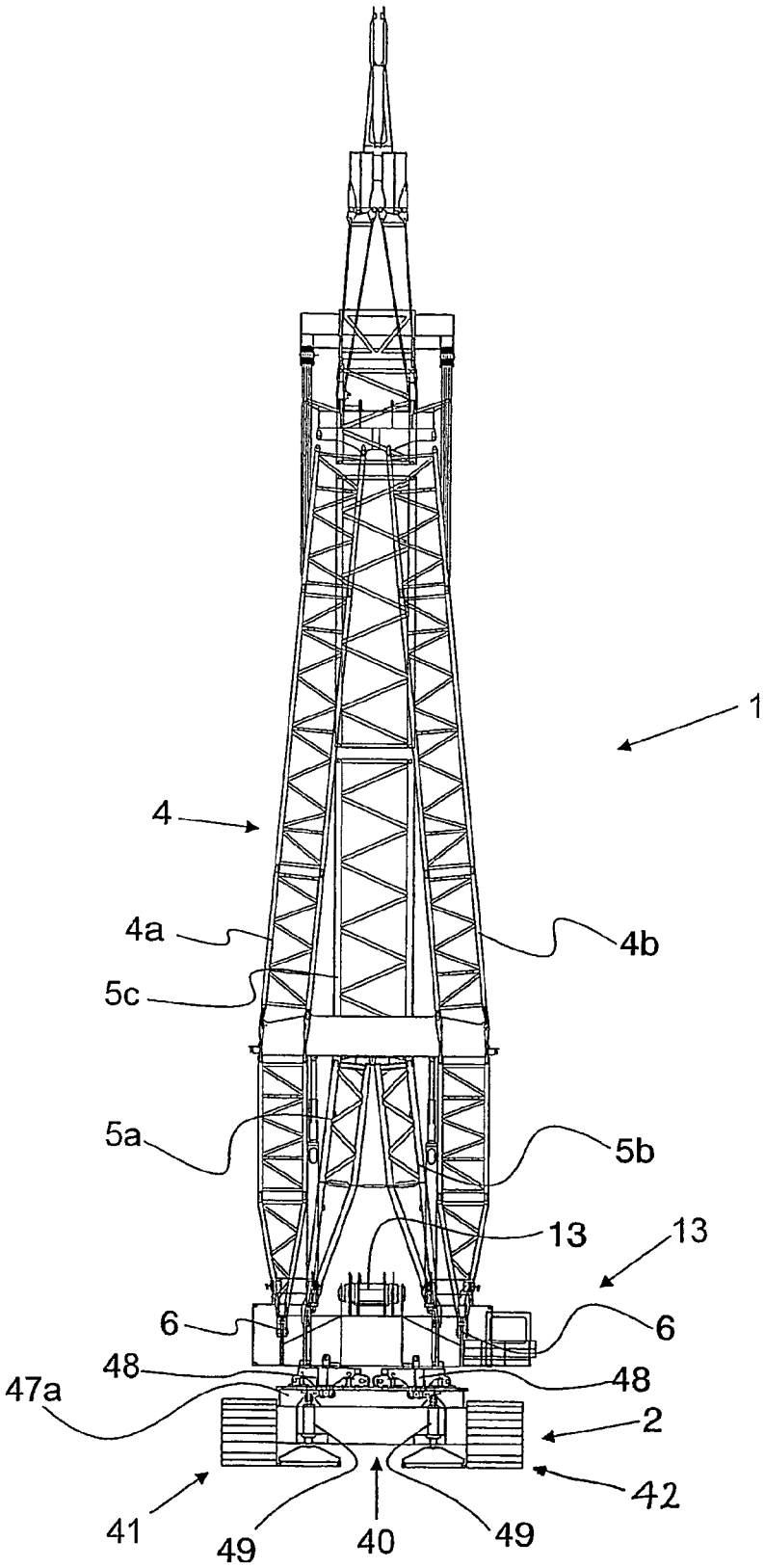
FIG. 2 depicts a front view of the embodiment of a crane depicted in FIG. 1.

With reference to the figures, FIG. 1 depicts a side view of an embodiment of a crawler crane. FIG. 2 depicts a front view of the embodiment of a crane depicted in FIG. 1. FIG. 1 and FIG. 2 depict different set-ups for different lift jobs using the embodied crawler crane 1 designed for lifting loads of several hundred metric tons (for example up to 1200 metric tons or even more). The crane 1 can be a self-propelled crane and have a travelling base structure 2 that allows for travel of the crane over a surface. In many cases, the surface will be the ground, possibly reinforced by a suitable foundation, but the crane 1 can also be used on a large pontoon or the like.

As depicted in the figures, a revolving superstructure 3 can be mounted on the base structure 2, so that the superstructure 3 can rotate about a vertical revolving axis with respect to the base structure 2.

The crane 1 further has a boom 4 and a backmast 5. The boom can be hinged to the superstructure 3 so that the boom 4 pivots about horizontal pivot axis 6. The backmast 5 can also be hinged to the superstructure 3 about a horizontal pivot axis 7.

In the embodiment depicted in FIG. 1 and FIG. 2, both the boom 4 and the backmast 5 have a lattice structure. The lattice structure allows for the boom 4 and the backmast 5 to be modular to allow for easy transport of the crane 1 from one construction site to the next. In FIG. 2, the boom 4 has an A-frame design with two elongated boom sections 4*a* and 4*b* separately connected to the superstructure 3 and merging towards each other near the top of the boom 4. The backmast 5 is depicted as having an inverted Y-frame design with two lower backmast sections 5*a* and 5*b* pivoted to the superstructure 3 and merging into a single section 5*c*.

Returning to FIG. 1, a luffing fly jib arrangement 8, including jib 8*a* and stay beams 8*b* and 8*c*, are connected to the top of the boom 4. A main load hoisting means is associated with the boom 4 for hoisting a load. In FIG. 1, a hoisting cable 11 is guided over cable pulleys 12 mounted on the top of the backmast 5 on the stay beams 8*b* and 8*c* and on the top of the jib 8*a*. A crane hook 13 is suspended from the hoisting cable 11. A main load-hoisting winch 13*a* is mounted on the revolving superstructure 3.

A superstructure ballast 15 can be composed of a stack of steel ballast plates. The rear end of the superstructure 3 can be adapted for supporting the superstructure ballast 15 thereon.

The crane 1 can have a superlift ballast 20 and associated connection means 30 serving to connect the superlift ballast 20 to the backmast 5 while the superlift ballast 20 is resting on the surface (as depicted in FIG. 1) and/or suspended from the backmast 5 above the surface. The connection means 30 can be formed by a superlift ballast cable 31 guided over a cable pulley 32 in the top of the backmast 5 and connected to a superlift ballast winch 33 mounted on the superstructure 3.

The travelling base structure 2 can be provided with superlift ballast support means that allow for supporting the superlift ballast 20 on the base structure 2 so that the superlift ballast 20 is movable along with the crane 1 while being supported by the base structure 2.

Figure 5:
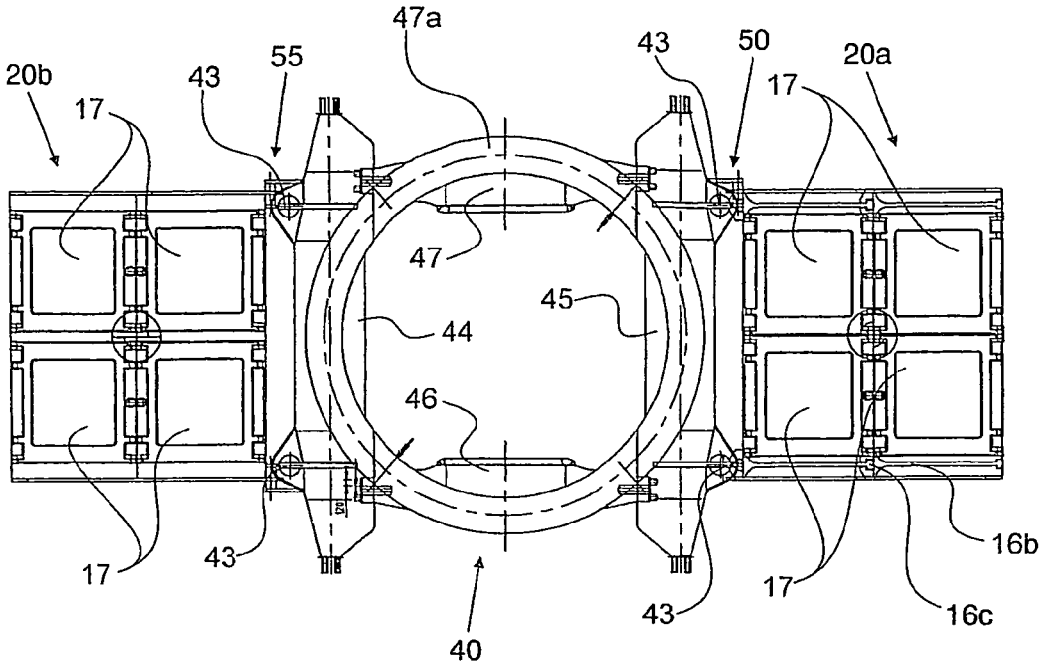
FIG. 5 depicts a plan view of the central chassis and the superlift ballast parts supported by the chassis of the embodiment of a crane depicted in FIG. 1.
Figure 6B:
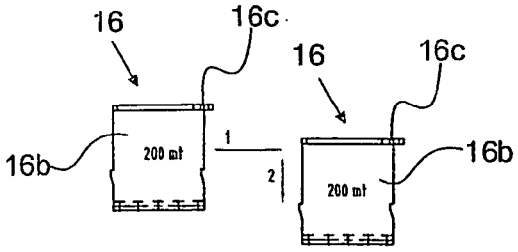
FIG. 6*a* and FIG. 6*b* depict an elevational cross-section of two trays of the superlift ballast parts depicted in FIG. 5 in an assembled and a disassembled state respectively.
Figure 6A:
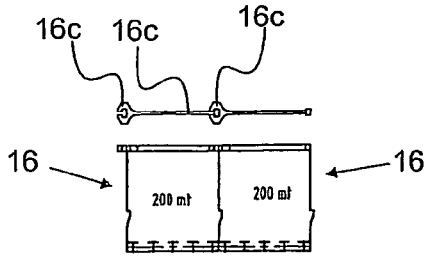

FIG. 5 depicts a plan view of the central chassis and the superlift ballast parts supported by the chassis of the embodiment of a crane depicted in FIG. 1. FIG. 6*a* and FIG. 6*b* depict an elevational cross-section of two trays of the superlift ballast parts depicted in FIG. 5 in an assembled and a disassembled state respectively. As depicted in FIG. 5, the travelling base structure 2 comprises a central chassis 40 and a first and second carriage assembly 41 and 42 on opposite lateral sides of the chassis 40. In an embodiment of the crane 1, the carriage assemblies 41 and 42 are designed as crawler assemblies each having a track. Other designs are also envisaged, such as wheeled carriage assemblies (for smaller cranes) or skid arrangements and the like.

FIG. 4*a*, FIG. 4*b*, FIG. 4*c*, FIG. 4*d*, FIG. 4*e*, and FIG. 4*f* depict successive plan views of the positioning of both superlift ballast parts onto the base structure of the embodiment of a crane depicted in FIG. 1. As depicted in FIG. 4*a* through FIG. 4*f*, the first and second crawler assemblies 41 and 42 protrude forward and rearward with respect to the central chassis 40.

Returning to the travelling base structure 2, the chassis 40 can be provided with a first and a second superlift ballast support means 50 and 55 can be located on opposite sides thereof, such as the to the front and to the rear of the chassis 40.

The superlift ballast 20 can comprise a first and a second superlift ballast part 20*a* 20*b* that are supportable on the first and second superlift ballast support means 50 and 55 respectively.

As depicted in FIG. 4*a* through FIG. 4*f*, the first and second superlift ballast support means 50 and 55 are adapted such that the first superlift ballast part 20*a* is supported essentially in front of the chassis 40 between the forward protruding carriage assembly parts. The second superlift ballast part 20*b* is supported essentially to the rear of the chassis 40 between the rearward protruding carriage assembly parts. The superlift ballast parts 20*a* and 20*b* can be supported such on the travelling base structure 2 that unhindered revolving motion of the superstructure 3 is possible when the ballast parts are supported on the chassis.

Figure 7:
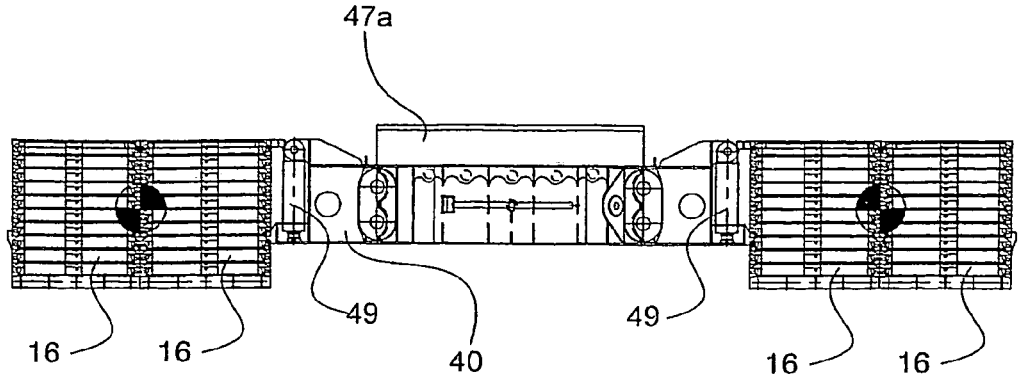
FIG. 7 depicts a longitudinal cross-section of the ballast parts of the superlift ballast parts depicted in FIG. 5.
Figure 8:
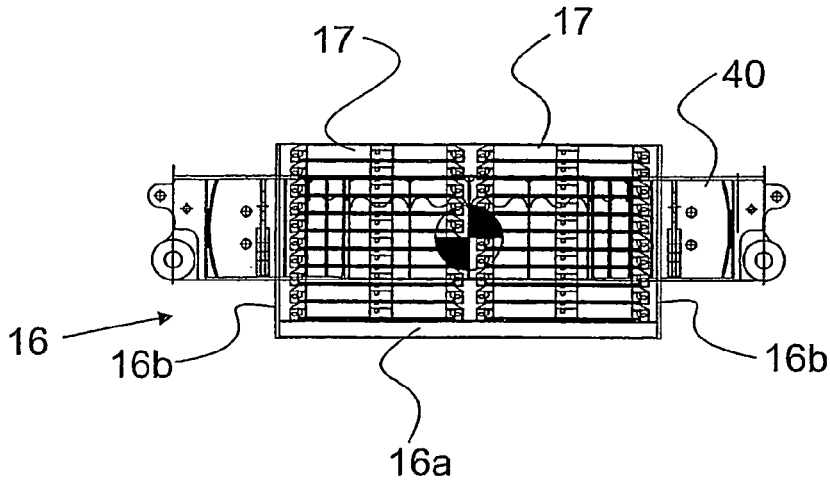
FIG. 8 depicts a front view of a ballast tray and superlift ballast plates stacked on the ballast tray.

FIG. 7 depicts a longitudinal cross-section of the ballast parts of the superlift ballast parts depicted in FIG. 5. FIG. 8 depicts a front view of a ballast tray and superlift ballast plates stacked on the ballast tray. As depicted FIG. 7 and FIG. 8, the first and second superlift ballast parts 20*a* and 20*b* can include two interconnectable ballast trays 16 and multiple ballast plates 17 stackable on the each of the ballast trays 16. Each tray 16 has a bottom 16*a* and sidewalls 16*b*. As depicted, the sidewalls 16*b* have a connection member 16*c* at one edge allowing for a sort of tongue-and-groove connection to the associated tray 16 and a corresponding vertical connection member 43 on the chassis 40.

As further depicted in FIG. 7 and FIG. 8, the chassis 40 can have two transverse beams 44 and 45 extending between the crawler assemblies and two longitudinal beams 46 and 47 interconnecting the transverse beams 44 and 45. On top of the beam structure, a slew ring 47*a* can be mounted onto a number of bogies 48 having rollers are supported. These bogies 48 support the superstructure 3 on the slew ring 47*a* in a rotatable manner as exampled in FIG. 2.

In FIG. 2 and FIG. 7, the hydraulic jacks 49 are visible on the chassis 40 near each of the carriage assemblies. The hydraulic jacks 49 serve to stabilize the crane 1 as the crane 1 is stationary on the surface.

Figure 3C:
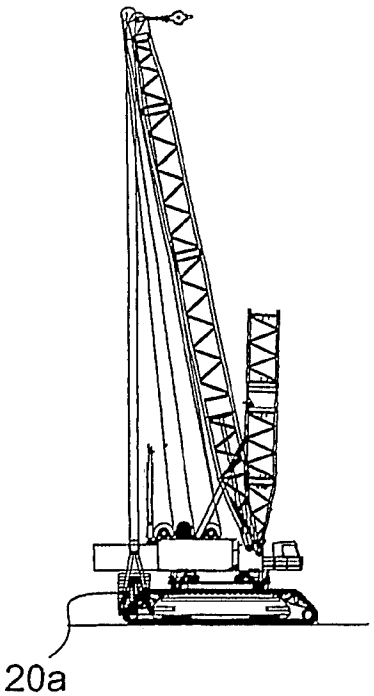
FIG. 3*a*, FIG. 3*b*, and FIG. 3*c* depict successive side views of the positioning a superlift ballast part onto the base structure of the embodiment of a crane depicted in FIG. 1.
Figure 3B:
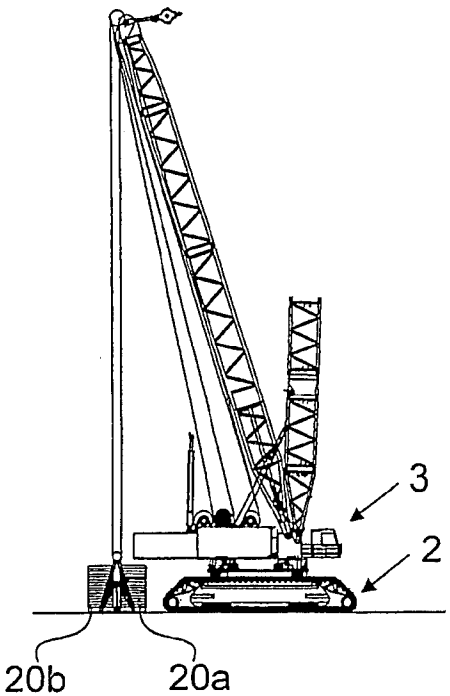
Figure 3A:
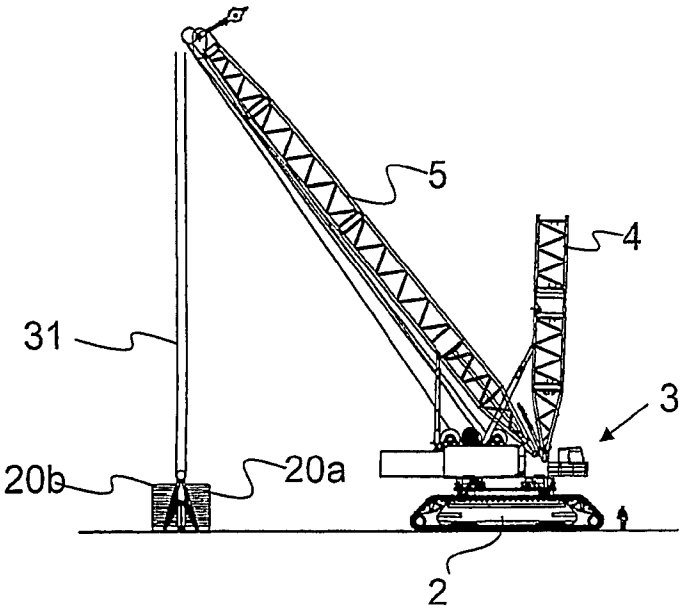

FIG. 3*a*, FIG. 3*b*, and FIG. 3*c* depict successive side views of the positioning a superlift ballast part onto the base structure of the embodiment of a crane depicted in FIG. 1. In conjunction with FIG. 4*a* through FIG. 4*f*, FIG. 3*a* through FIG. 3*c* example an embodiment of method for placing of the superlift ballast parts 20*a* and 20*b* onto the base structure 2.

Figures 4A, 4B, 4C, 4D, 4E, 4F:
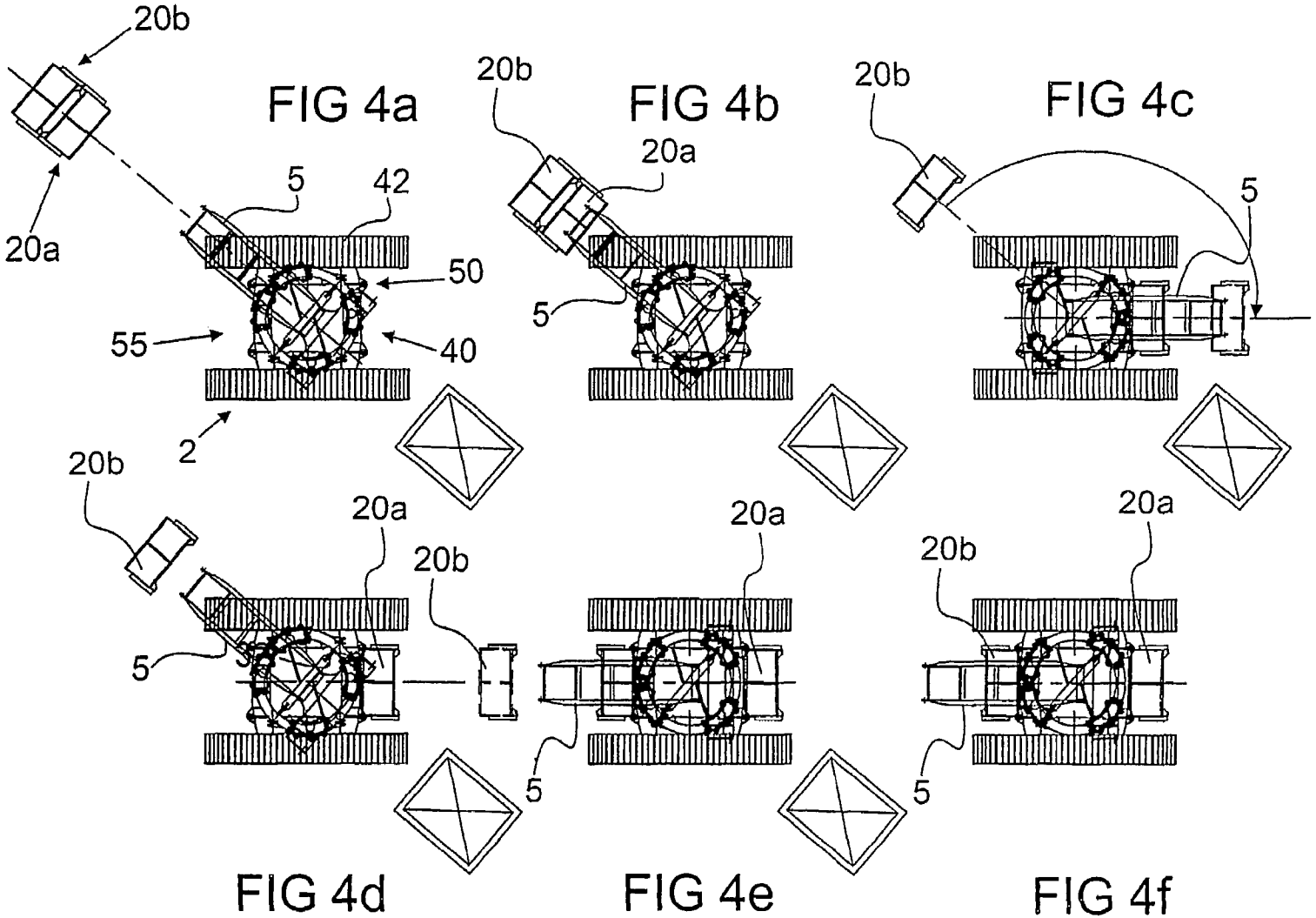
FIG. 4*a*, FIG. 4*b*, FIG. 4*c*, FIG. 4*d*, FIG. 4*e*, and FIG. 4*f* depict successive plan views of the positioning of both superlift ballast parts onto the base structure of the embodiment of a crane depicted in FIG. 1.

In FIG. 3*a* and FIG. 4*a*, the superlift ballast parts 20*a* and 20*b* are resting on the surface at a distance remote from the base structure 2. As depicted in FIG. 3*b* and FIG. 4*b*, the entire super ballast 20 is brought closer to the base structure 2 by lifting the ballast 20 from the surface and topping the backmast 5. The ballast 20 is then lowered onto the ground and the ballast parts 20*a* and 20*b* are disconnected from each other. The ballast lifting cable 31 is then connected only to the ballast part 20*a*, which is then lifted.

As depicted in FIG. 3*c* and FIG. 4*c*, by slewing the superstructure 3, the ballast part 20*a* is brought between the forward parts of the crawler assemblies and then lowered so that the ballast part 20*a* comes to rest on the associated support means 50 of the chassis 40. The ballast lifting cable is then disconnected from the ballast part 20*a*.

Continuing with the method, the superstructure 3 is slewed back so that the cable can be attached to the other superlift ballast part 20*b*. This ballast part 20*b* is then lifted and by slewing the superstructure 3 and topping the backmast 5. The ballast part 20*b* is brought between the rear end of the crawler assemblies. The ballast part 20*b* is then lowered onto the associated support means 55 of the chassis 40. Alternative sequences for placing the ballast parts 20*a* and 20*b* on the base structure 2 are also possible.

The mobile crane 1 can be moved to another job location and the superlift ballast 20 can be taken along with the crane 1. The handling of the superlift ballast 20 in this manner is efficient and does not require additional cranes and transport vehicles when moving the crane 1 from one job site to the next.

The superlift ballast 20 can consist of one part only, which is then supported on a suitable location on the travelling base structure. The multiple superlift ballast parts should be supported on opposite sides of the chassis, but is not limiting to the embodiments.

While these embodiments have been described with emphasis on the embodiments, it can be understood that within the scope of the appended claims, the embodiments might be practiced other than as specifically described herein.

What is claimed is:

1. A mobile crane comprising:

(a) a travelling base structure adapted to allow the mobile crane to travel over a surface;

(b) a revolving superstructure mounted on the travelling base structure;

(c) a boom and a backmast, wherein the boom and the backmast are hinged about an associated pivot axis horizontal to the revolving superstructure;

(d) a main load hoisting means associated with the boom for hoisting a load;

(e) a superstructure ballast, wherein the superstructure ballast is supported by the revolving superstructure;

(f) a removable and repositionable superlift ballast with connection means suspending the superlift ballast, and a first and second superlift ballast support means, wherein the connection means connect the superlift ballast to the backmast; and wherein the first and second superlift ballast support means are adapted to support the superlift ballast on the travelling base structure so that the superlift ballast is transportable with the mobile crane when the mobile crane is moved from one job site to another while being supported by the travelling base structure, forming the mobile crane with the removable and repositionable superlift ballast.

2. The mobile crane of claim 1, wherein the superlift ballast is supported on the travelling base structure so that revolving motion of the revolving superstructure is unhindered.

3. The mobile crane of claim 1, wherein the travelling base structure further comprises a central chassis, a first carriage assembly, and a second carriage assembly, wherein the first carriage assembly and the second carriage assembly are located on opposite lateral sides of the central chassis.

4. The mobile crane of claim 3, wherein the first carriage assembly and the second carriage assembly are crawler assemblies.

5. The mobile crane of claim 3, wherein the first superlift ballast support means and the second superlift ballast support means are located on opposite sides of the travelling base structure, and wherein the superlift ballast comprises first superlift ballast parts and second superlift ballast parts that are supported on the first superlift ballast support means and the second superlift ballast support means respectively.

6. The mobile crane of claim 5, wherein the first carriage assembly and the second carriage assembly protrude forward and rearward with respect to the central chassis, and wherein the first superlift ballast support means and the second superlift ballast support means are adapted such that the first superlift ballast parts are supported essentially in front of the central chassis in the first carriage assembly protruding forward and the second superlift ballast parts are supported essentially to the rear of the central chassis in the second carriage assembly protruding rearward.

7. The mobile crane of claim 6, wherein the first superlift ballast parts and the second superlift ballast parts each include a ballast tray and a plurality of ballast plates stackable on the ballast tray.

8. The mobile crane of claim 7, wherein each ballast tray is provided with interconnection means to allow the ballast trays to interconnect so that the ballast trays when interconnected are usable during lifting the load by the mobile crane.

9. The mobile crane of claim 1, further comprising a superlift ballast hoist means associated with the backmast, wherein the superlift ballast hoist means are adapted to suspend the superlift ballast from the backmast.

10. The mobile crane of claim 1, wherein the first superlift ballast support means and the second superlift ballast support means are located on opposite sides of the travelling base structure, and wherein the superlift ballast comprises a first superlift ballast part and a second superlift ballast part that are supported on the first superlift ballast support means and the second superlift ballast support means respectively.

* * * * *